US007749338B2

(12) United States Patent
Yokoi et al.

(10) Patent No.: US 7,749,338 B2
(45) Date of Patent: Jul. 6, 2010

(54) HIGH BURRING, HIGH STRENGTH STEEL SHEET EXCELLENT IN SOFTENING RESISTANCE OF WELD HEAT AFFECTED ZONE AND METHOD OF PRODUCTION OF SAME

(75) Inventors: Tatsuo Yokoi, Oita (JP); Teruki Hayashida, Oita (JP); Masahiro Ohara, Oita (JP); Kouichi Tsuchihashi, Oita (JP)

(73) Assignee: Nippon Steel Corporation, Tokyo (JP)

( * ) Notice: Subject to any disclaimer, the term of this patent is extended or adjusted under 35 U.S.C. 154(b) by 209 days.

(21) Appl. No.: 10/540,628

(22) PCT Filed: Nov. 28, 2003

(86) PCT No.: PCT/JP03/15275

§ 371 (c)(1),
(2), (4) Date: Jun. 23, 2005

(87) PCT Pub. No.: WO2004/059021

PCT Pub. Date: Jul. 15, 2004

(65) Prior Publication Data

US 2006/0081312 A1 Apr. 20, 2006

(30) Foreign Application Priority Data

Dec. 24, 2002 (JP) ..... 2002-372540

(51) Int. Cl.
*C22C 38/12* (2006.01)
*C22C 38/14* (2006.01)

(52) U.S. Cl. ..... 148/320; 148/333; 148/334; 148/335; 420/126; 420/104; 420/105; 420/106

(58) Field of Classification Search ..... 148/320, 148/330–336; 420/104–105, 126, 110, 106
See application file for complete search history.

(56) References Cited

U.S. PATENT DOCUMENTS 4,388,122 A * 6/1983 Sudo et al. ..... 148/602

(Continued)

FOREIGN PATENT DOCUMENTS

EP 0 666 332 8/1995

(Continued)

OTHER PUBLICATIONS

Computer-generated English translation of Japanese patent 08-157957, Takahiro Kashima et al., Jun. 18, 1996.*

(Continued)

*Primary Examiner*—Deborah Yee
(74) *Attorney, Agent, or Firm*—Kenyon & Kenyon LLP

(57) ABSTRACT

The present invention provides high burring, high strength steel sheet excellent in softening resistance of the weld heat affected zone and a method of production of the same, that is, high burring, high strength steel sheet excellent in softening resistance of the weld heat affected zone containing, by wt %, C: 0.01 to 0.1%, Si: 0.01 to 2%, Mn: 0.05 to 3%, P≦0.1%, S≦0.03%, Al: 0.005 to 1%, N: 0.0005 to 0.005%, and Ti: 0.05 to 0.5% and further containing C, S, N, Ti, Cr, and Mo in ranges satisfying 0%<C−(12/48Ti−12/14N−12/32S)≦0.05%, Mo+Cr≧0.2%, Cr≦0.5%, and Mo≦0.5%, the balance being Fe and unavoidable impurities, wherein the microstructure comprises ferrite or ferrite and bainite.

4 Claims, 2 Drawing Sheets

U.S. PATENT DOCUMENTS

| | | | | |
|---|---|---|---|---|
| 6,632,295 | B2 * | 10/2003 | Nakata et al. | 148/320 |
| 6,666,932 | B2 * | 12/2003 | Funakawa et al. | 148/328 |
| 2002/0162613 | A1 | 11/2002 | Kashima et al. | |

FOREIGN PATENT DOCUMENTS

| | | | |
|---|---|---|---|
| EP | 1 026 278 | | 8/2000 |
| EP | 1 201 780 | | 5/2002 |
| JP | 06-200351 | | 7/1994 |
| JP | 07-011382 | | 1/1995 |
| JP | 08-157957 | * | 6/1996 |
| JP | 08-269538 | | 10/1996 |
| JP | 9-272923 | A | 10/1997 |
| JP | 2000-087175 | | 3/2000 |
| JP | 2000-178654 | | 6/2000 |
| JP | 2001-20039 | A | 1/2001 |
| JP | 2001-220647 | A | 8/2001 |
| JP | 2002-146471 | | 5/2002 |
| JP | 2002-285239 | | 10/2002 |
| JP | 2002-363685 | A | 12/2002 |
| JP | 2003-34825 | A | 2/2003 |
| JP | 2003-105446 | A | 4/2003 |
| KR | 2001-60651 | | 7/2001 |
| WO | WO 02/36840 | A1 | 5/2002 |

OTHER PUBLICATIONS

European Search Report dated Feb. 23, 2006 issued in corresponding European Application No. 03 77 5966.

* cited by examiner

HIGH BURRING, HIGH STRENGTH STEEL SHEET EXCELLENT IN SOFTENING RESISTANCE OF WELD HEAT AFFECTED ZONE AND METHOD OF PRODUCTION OF SAME

TECHNICAL FIELD

The present invention relates to high burring, high strength steel sheet having a tensile strength of 540 MPa or more excellent in softening resistance of the weld heat affected zone and a method of production of the same, more particularly relates to high burring, high strength steel sheet excellent in softening resistance of the weld heat affected zone suitable as a material used for applications such as auto parts where both workability and weld zone strength are sought in the case of spot, arc, plasma, laser, or other welding after being formed or in the case of being formed after such welding and a method of production of the same.

BACKGROUND ART

In recent years, for lightening weight for improving the fuel efficiency of automobiles etc., Al alloys and other light metals or high strength steel sheet have been increasingly used for auto parts and members.

However, Al alloys and other light metals have the advantage of being high in relative strength, but are remarkably higher in price compared with steel, so their use has been limited to specialty applications. To promote reduction of the weight of automobiles in a broader area, use of inexpensive high strength steel sheet is being strongly sought.

In general, materials become worse in formability the higher the strength. Ferrous metal materials are no exception. Attempts have been made to achieve both high strength and high ductility up until now. Further, another characteristic sought in a material used for auto parts is, in addition to ductility, burring. However, burring also exhibits a tendency to fall along with higher strength, so the improvement of burring is also becoming a topic in use of high strength steel sheet fir auto parts. On the other hand, auto parts are comprised of press formed and other worked members assembled together by spot, arc, plasma, laser, and other welding. Further, recently, steel sheet has been welded together, then press formed in some cases. Whatever the case, the weld strength at the time of forming or the time of use assembled as a part is extremely important from the viewpoints of the forming limits and safety. Therefore, in application of high strength steel sheet to auto parts etc., the burring and the weld zone strength also become important issues for study.

For high strength steel sheet excellent in burring, an invention adding Ti and Nb to reduce the second phase and cause precipitation strengthening by TiC and NbC in the main phase of polygonal ferrite so as to obtain high strength rolled steel sheet excellent in stretch flange formability has been proposed (Japanese Unexamined Patent Publication (Kokai) No. 6-200351).

Further, an invention adding Ti and Nb so as to reduce the second phase, make the microstructure acicular ferrite, and cause precipitation strengthening by TiC and NbC to obtain high strength, hot rolled steel sheet excellent in stretch flange formability has also been proposed (Japanese Unexamined Patent Publication (Kokai) No. 7-11382).

On the other hand, as technology for improving the weld zone strength, an invention complexly adding Nb and Mo so as to suppress the softening of the weld zone in steel sheet has been proposed (Japanese Unexamined Patent Publication (Kokai) No. 2000-87175).

Further, an invention making active use of the precipitation of NbN to suppress softening of the weld zone so as to obtain steel sheet comprised of ferrite and martensite has also been proposed (Japanese Unexamined Patent Publication (Kokai) No. 2000-178654).

However, in suspension arms, front side members, and steel sheet for other parts, burring and other formability and the strength of the weld zone are very important. In the above prior art, the two characteristics could never simultaneously be satisfied. Further, for example, even if the two characteristics are satisfied, provision of a method of production enabling production inexpensively and safely is important. The above prior art must be said to be insufficient.

That is, in the invention described in Japanese Unexamined Patent Publication (Kokai) No. 6-200351, to obtain a high stretch flange formability, an area ratio of at least 85% of polygonal ferrite is essential, but to obtain a 85% or higher polygonal ferrite, the steel has to be held for a long time to promote the growth of the ferrite grains after hot rolling. This is not preferable in operating costs.

Further, in the invention described in Japanese Unexamined Patent Publication (Kokai) No. 7-11382, due to the microstructure with the high dislocation density and the precipitation of fine TiC and/or NbC, just a ductility of about 17% at 80 kgf/mm$^2$ is obtained and the formability is insufficient.

Further, these inventions do not allude at all to softening of the weld zone. On the other hand, the invention described in Japanese Unexamined Patent Publication (Kokai) No. 2000-87175 does not describe anything regarding the improvement of burring.

Further, the invention described in Japanese Unexamined Patent Publication (Kokai) No. 2000-178654 relates to a complex ferrite-martensite structure steel, which is clearly different from the technology of the present invention for obtaining a microstructure of steel sheet excellent in burring.

DISCLOSURE OF THE INVENTION

The present invention solves these problems and provides high burring, high strength steel sheet excellent in softening resistance of the weld heat affected zone suitable as a material for use in applications such as auto parts where both workability and weld zone strength are demanded in the case of spot, arc, plasma, laser, or other welding after being formed or the case of being formed after welding, and a method of production of the same. That is, the present invention has as its object the provision of high burring, high strength steel sheet having a tensile strength of 540 MPa or more excellent in softening resistance of the weld heat affected zone and a method of production enabling that steel sheet to be produced inexpensively and stably.

The inventors kept in mind the process of production of thin steel sheet being produced on an industrial scale by production facilities currently ordinarily employed and engaged in intensive studies to improve the softening resistance of the weld heat affected zone of high burring, high strength steel sheet. As a result, they discovered that high burring, high strength steel sheet containing C: 0.01 to 0.1%, Si: 0.01 to 2%, Mn: 0.05 to 3%, P≦0.1%, S≦0.03%, Al: 0.005 to 1%, N: 0.0005 to 0.005%, and Ti: 0.05 to 0.5%, further containing C, S, N, and Ti in ranges satisfying $0<C-(12/48Ti-12/14N-12/32S)\leqq 0.05\%$, $Mo+Cr\geqq 0.2\%$, $Cr\leqq 0.5\%$, and $Mo\leqq 0.5\%$, the balance comprising Fe and unavoidable impurities, and having a microstructure comprised of ferrite or ferrite and bainite, is extremely excellent in burring, but has a weld heat affected zone which remarkably softens. Further, they pinpointed the cause of the softening of the weld heat affected zone of said high burring, high strength steel sheet as being the tempering of the microstructure due to the welding thermal history and newly discovered that to improve the softening resistance, complex addition of Cr and Mo was extremely effective, and thereby completed the present invention. That is, the gist of the present invention is as follows:

(1) High burring, high strength steel sheet excellent in softening resistance of the weld heat affected zone characterized by containing, by wt %, C: 0.01 to 0.1%, Si: 0.01 to 2%, Mn: 0.05 to 3%, P≦0.1%, S≦0.03%, Al: 0.005 to 1%, N: 0.0005 to 0.005%, and Ti: 0.05 to 0.5% and further containing C, S, N, Ti, Cr, and Mo in ranges satisfying 0%<C−(12/48Ti−12/14N−12/32S) ≦0.05% and Mo+Cr≧0.2%, Cr≦0.5%, and Mo≦0.5%, the balance comprising Fe and unavoidable impurities, wherein the microstructure is comprised of ferrite or ferrite and bainite.

(2) High burring, high strength steel sheet excellent in softening resistance of the weld heat affected zone characterized in that said steel further contains, by wt %, Nb: 0.01 to 0.5% and further contains Nb in a range satisfying O<C−(12/48Ti−12/93Nb−12/14N−12/32S)≦0.05%, the balance comprising Fe and unavoidable impurities.

(3) High burring, high strength steel sheet excellent in softening resistance of the weld heat affected zone as set forth in (1) or (2), characterized by further containing, by wt %, one or two of Ca: 0.0005 to 0.002%, a REM: 0.0005 to 0.02%, Cu: 0.2 to 1.2%, Ni: 0.1 to 0.6%, and B: 0.0002 to 0.002%.

(4) High burring, high strength steel sheet excellent in softening resistance of the weld heat affected zone as set forth in any one of (1) to (3), characterized by being automotive thin steel sheet coated with zinc.

(5) A method of production of high burring, high strength steel sheet excellent in softening resistance of the weld heat affected zone characterized by hot rolling a slab having the ingredients for obtaining the thin steel sheet as set forth in any one of (1) to (3) at which time ending finish rolling at a temperature region of the $Ar_3$ transformation point temperature +30° C. or more, then cooling within 10 seconds by a cooling rate of an average cooling rate until the end of cooling of 50° C./sec or more until a temperature region of 700° C. or less, and coiling at a coiling temperature of 350° C. to 650° C.

(6) A method of production of high burring, high strength steel sheet excellent in softening resistance of the weld heat affected zone characterized by hot rolling a slab having the ingredients for obtaining the thin steel sheet as set forth in any one of (1) to (3), pickling it, cold rolling it, then holding it at a temperature region of 800° C. or more for 5 to 150 seconds, then cooling it by a cooling rate of an average cooling rate of 50° C./sec or more until a temperature region of 700° C. or less as a heat treatment process.

(7) A method of production of high burring, high strength steel sheet excellent in softening resistance of the weld heat affected zone as set forth in (5), characterized by dipping the steel sheet in a zinc coating bath after the end of the hot rolling process to coat the surface with zinc.

(8) A method of production of high burring, high strength steel sheet excellent in softening resistance of the weld heat affected zone as set forth in (6), characterized by dipping the steel sheet in a zinc coating bath after the end of the heat treatment process to coat the surface with zinc.

(9) A method of production of high burring, high strength steel sheet excellent in softening resistance of the weld heat affected zone as set forth in (7) or (8), characterized by alloying after dipping the steel sheet in a zinc coating bath for coating zinc.

BEST MODE FOR WORKING THE INVENTION

Figure 2:
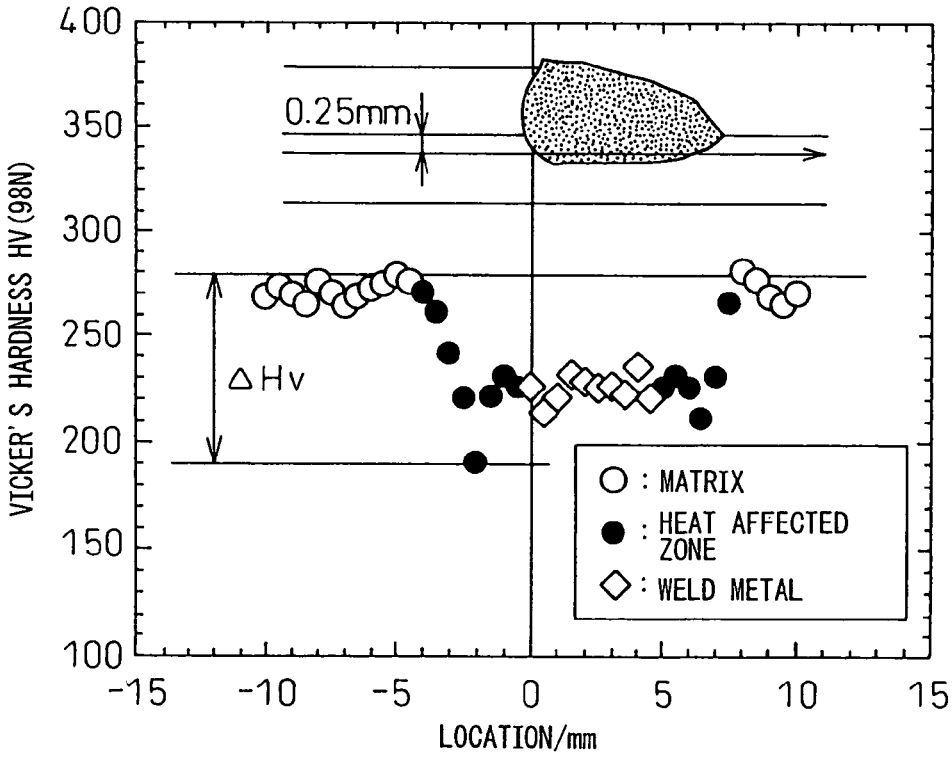
FIG. 2 is a view of the relationship with the hardness of the arc weld zone for steel sheets of compositions with amounts of C* and amounts of Cr+Mo changed.

First, the inventors investigated the effects on the softening resistance of the weld heat affected zone exerted by the amount of C* (C*=C−(12/48Ti−12/14N−12/32S), hereinafter referred to as "C*") and the Cr and Mo contents. The test materials for this were prepared as follows. That is, the inventors hot rolled slabs comprised of basically 0.05% C-1.0% Si-1.4% Mn-0.01% P0.001% S and adjusted in ingredients to change the amount of C* (Ti and N content) and amount of Cr+Mo, coiled them at ordinary temperature, held them at 550° C. for 1 hour, then furnace cooled them as heat treatment. The inventors measured the hardnesses of the arc weld zones of these steel sheets. The results are shown in FIG. 2.

Figure 1:
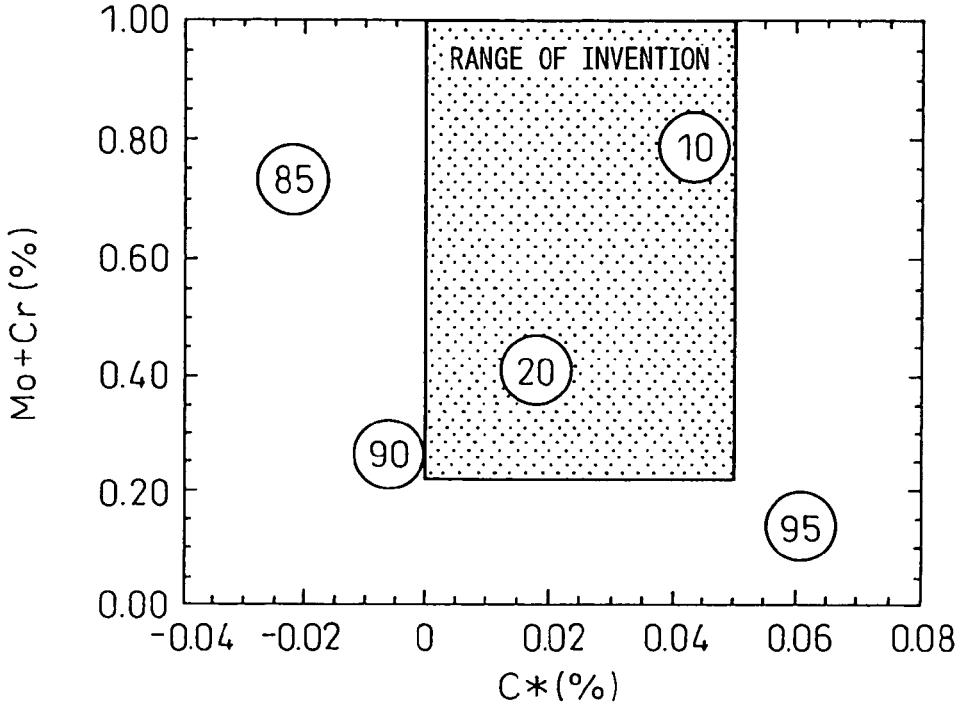
FIG. 1 is a view of the relationship between the amount of C* and amount of Cr+Mo and the softening degree ΔHv of the weld heat affected zone.

Here, from these results, the inventors newly discovered that the amount of C* and amount of Cr+Mo are strongly correlated with the softening degree ΔHv of the weld heat affected zone (ΔHv defined as Hv (average value of matrix hardness)—Hv (hardness of weld heat affected zone): see FIG. 1) and that when the amount of C* is 0 to 0.05% and the amount of Cr+Mo is 0.2% or more, the softening of the weld heat affected zone is remarkably suppressed.

This mechanism is not necessarily clear, but a material obtaining strength by a bainitic microstructure sometimes softens at the heat affected zone in an arc welding or other welding thermal cycle. It is believed that Mo or Cr clusters or precipitates with C and other elements even in welding or another short thermal cycle so as to raise the strength and as a result suppresses the softening of the heat affected zone. However, with a total of the contents of Mo and Cr of less than 0.2%, the effect is lost.

On the other hand, to obtain Mo or Cr carbides etc., at least the equivalent of C fixed by TiC or other carbides precipitating at a high temperature must be contained. Therefore, with C*≦0, this effect is lost.

Note that for measurement of the hardness of the weld heat affected zone of arc welding, a No. 1 test piece described in JIS Z 3101 was measured in accordance with the test method described in JIS Z 2244. However, the arc welding was performed with a shield gas of $CO_2$, a wire of YM-60C, ϕ1.2 mm made by Nippon Steel Welding Products and Engineering Co., Ltd., a welding rate of 100 cm/min, a welding current of 260±10 A, a welding voltage of 26±1V, a thickness of the test material of 2.6 mm, a hardness measurement position of 0.25 mm from the surface, a measurement distance of 0.5 mm, and a test force of 98 kN.

Next, the microstructure of the steel sheet in the present invention will be explained.

The microstructure of the steel sheet is preferably a single phase of ferrite to secure superior burring. However, in accordance with need, the inclusion of some bainite is allowed, but to secure good burring, a volume fraction of bainite of 10% or less is preferable. Note that the "ferrite" referred to here includes bainitic ferrite and acicular ferrite structures. Further, "bainite" is a structure including cementite and other carbides between ferrite laths or including cementite and other carbides inside ferrite laths when observing thin film by a transmission type electron microscope. On the other hand, "bainitic ferrite and acicular ferrite structures" means structures not including carbides inside ferrite laths and between ferrite laths other than Ti and Nb carbides.

Further, unavoidable martensite and residual austenite and pearlite may be included, but to secure good burring, the volume fraction of the residual austenite and martensite combined is preferably less than 5%. Further, to secure good fatigue characteristics, a volume fraction of pearlite including rough carbides is preferably 5% or less. Further, here, the volume fractions of ferrite, bainite, residual austenite, pearlite, and martensite are defined as the area fractions of the microstructure at ¼ sheet thickness when polishing a sample cut out from a ¼ W or ¾ W position of the thickness of the steel sheet at the cross-section in the rolling direction, etching it with a Nytal reagent, and observing it using an optical microscope at a power of ×200 to ×500.

Next, the reasons for limitation of the chemical ingredients of the present invention will be explained.

C is one of the most important elements in the present invention. That is, C clusters or precipitates with Mo or Cr even in welding or another short thermal cycle and suppresses softening of the weld heat affected zone as an effect. However, if contained in an amount over 0.1%, the workability and weldability deteriorate, so the amount is made 0.1% or less. Further, if less than 0.01%, the strength falls, so the amount is made 0.01% or more.

Si is effective for raising the strength as a solution strengthening element. To obtain the desired strength, 0.01% or more is required. However, if contained in an amount over 2%, the workability deteriorates. Therefore, the content of Si is made 0.01% to 2% or less.

Mn is effective for raising the strength as a solution strengthening element. To obtain the desired strength, 0.05% or more is required. Further, when Ti and other elements besides Mn suppressing the occurrence of hot cracking due to S are not sufficiently added, addition, by wt %, of an amount of Mn giving $Mn/S \geqq 20$ is preferable. On the other hand, if adding over 3%, slab cracking occurs, so 3% or less.

P is an impurity and is preferably as low as possible. If contained in an amount over 0.1%, it has a detrimental effect on the workability and weldability and causes a drop in the fatigue characteristics as well, so is made 0.1% or less. S, if too great in content, causes cracking at the time of hot rolling, so should be reduced as much as possible, but 0.3% or less is an allowable range.

Al has to be added in an amount of 0.005% or more for deoxidation of the molten steel, but invites a rise in cost, so its upper limit is made 1%. Further, if added in too large an amount, it causes nonmetallic inclusions to increase and the elongation to deteriorate, so preferably the amount is made 0.5% or less.

N forms precipitates with Ti and Nb at higher temperatures than C and causes a reduction in the Ti and Nb effective for fixing the desired C. Therefore, it should be reduced as much as possible, but 0.005% or less is an allowable range.

Ti is one of the most important elements in the present invention. That is, Ti contributes to the rise in strength of the steel sheet due to precipitation strengthening. However, with less than 0.05%, this effect is insufficient, while even if contained in over 0.5%, not only is the effect saturated, but also a rise in the alloy cost is incurred. Therefore, the content of Ti is made 0.05% to 0.5%. Further, to fix by precipitation the C causing cementite or other carbides causing burring to deteriorate so as to improve the burring, it is necessary to meet the condition $C-(12/48Ti-12/14N-12/32S) \leqq 0.05\%$. On the other hand, from the viewpoint of suppression of softening of the weld heat affected zone, enough solid solution C for causing Mo or Cr to cluster or precipitate is required, so $0<C-(12/48Ti-12/14N-12/32S)$ is set.

Mo and Cr are some of the most important elements in the present invention. Even in welding or other short thermal cycles, they cluster or precipitate with C and other elements to suppress softening of the heat affected zone. However, if the total of the contents of Mo and Cr is less than 0.2%, the effect is lost. Further, even if contained in amounts over 0.5%, the effect is saturated, so $Mo \leqq 0.5\%$ and $Cr \leqq 0.5\%$ are set.

Nb contributes to the rise in strength of the steel sheet due to precipitation strengthening in the same way as Ti. However, with less than 0.01%, this effect is insufficient, while even if contained in an amount over 0.5%, not only does the effect become saturated, but also a rise in the alloy cost is incurred. Therefore, the content of Nb is made 0.01% to 0.5%. Further, it is necessary to fix by precipitation the C causing cementite and other carbides causing deterioration of the burring and therefore to satisfy the condition $C-(12/48Ti+12/93Nb-12/14N-12/32S) \leqq 0.05\%$. On the other hand, from the viewpoint of suppression of softening of the weld heat affected zone, enough solid solution C for causing the Mo or Cr to cluster or precipitate is needed, so $0<C-(12/48Ti+12/93Nb-12/14N-12/32S)$ is set.

Ca and REMs are elements changing the forms of the nonmetallic inclusions forming starting points of cracking or causing deterioration of the workability to make them harmless. However, even if added in amounts of less than 0.005%, there is no effect, while if adding Ca in an amount of more than 0.02% and a REM in an amount of more than 0.2%, the effect is saturated, so addition of Ca in an amount of 0.005 to 0.02% and a REM in an amount of 0.005 to 0.2% is preferable.

Cu has the effect of improving the fatigue characteristics in the solid solution state. However, with less than 0.2%, the effect is small, while if included in an amount over 1.2%, it precipitates during coiling and precipitation strengthening causes the steel sheet to remarkably rise in static strength, so the workability is seriously degraded. Further, in such Cu precipitation strengthening, the fatigue limit does not rise as much as the rise in the static strength, so the fatigue limit ratio ends up falling. Therefore, the content of Cu is made 0.2 to 1.2% in range.

Ni is added in accordance with need to prevent hot embrittlement due to the Cu content. However, if less than 0.1%, the effect is small, while if added in an amount of over 1%, the effect is saturated, so this is made 0.1 to 1%.

B has the effect of suppressing the granular embrittlement due to P believed to be caused by the reduction in the amount of solid solution C and therefore of raising the fatigue limit, so is added in accordance with need. Further, when the matrix strength is 640 MPa or more, a location in the weld heat affected zone receiving a thermal history of $\alpha \rightarrow \gamma \rightarrow \alpha$ transformation has a low Cep, so is not hardened and is liable to soften. In this case, by adding B for improving the hardenability, the softening at that location is suppressed. There is the effect that the fracture behavior of the joint is shifted from the weld zone to the matrix, so this is added in accordance with need. However, addition of less than 0.0002% is insufficient for obtaining these effects, while addition of over 0.002% causes slab cracking. Accordingly, B is added in an amount of 0.0002% to 0.002%.

Further, to impart strength, it is also possible to add one or two or more types of V and Zr precipitation strengthening or solution strengthening elements. However, with less than 0.02% and 0.02%, respectively, this effect cannot be obtained. Further, even if added in amounts over 0.2% and 0.2% respectively, the effect is saturated.

Note that the steel having these as main ingredients may also contain Sn, Co, Zn, W, and Mg in a total of 1% or less. However, Sn is liable to cause defects at the time of hot rolling, so 0.05% or less is preferable.

Next, the reasons for limitation of the method of production of the present invention will be explained in detail below.

The present invention can be obtained as cast, hot rolled, then cooled; as hot rolled; as hot rolled, then cooled, pickled, cold rolled, then heat treated; or as hot rolled steel sheet or cold rolled steel sheet heat treated by a hot dip line; and further as these steel sheets given separate surface treatment.

The method of production preceding the hot rolling in the present invention is not particularly limited. That is, after melting in a blast furnace or electric furnace etc., it is sufficient to perform various types of secondary refining to adjust the ingredients to give the target contents of ingredients, then cast this by the usual continuous casting, casting by the ingot method, thin slab casting, or another method. For the material, scrap may also be used. In the case of a slab obtained by continuous casting, the slab may be directly conveyed as a hot slab to the hot rolling mill or may be cooled to room temperature, then reheated in a heating furnace, then hot rolled.

The reheating temperature is not particularly limited, but if 1400° C. or more, the scale off becomes large and the yield falls, so the reheating temperature is preferably less than 1400° C. Further, heating at less than 1000° C. seriously detracts from the operational efficiency in schedules, so the reheating temperature is preferably 1000° C. or more. Further, heating at less than 1100° C. not only results in precipitates including Ti and/or Nb not redissolving in the slab, but roughening and causing a loss of the precipitation strengthening, but also the precipitates including Ti and/or Nb in the sizes and distributions desirable for burring no longer precipitate, so the reheating temperature is preferably 1100° C. or more.

The hot rolling process comprises rough rolling, then finish rolling, but after rough rolling or after its succeeding descaling, it is also possible to bond a sheet bar and consecutively finish roll it. At that time, it is also possible to coil a rough bar once into a coil shape, store it in a cover having a heat retaining function in accordance with need, again uncoil it, then bond it. Further, the subsequent finish rolling is preferably performed within 5 seconds so as to prevent the formation of scale again after descaling.

The finish rolling has to end in a temperature region where the final pass temperature (FT) is the $Ar_3$ transformation point+30° C.° C. or more. This is because to obtain the bainitic ferrite or ferrite and bainite desirable for burring in the cooling process after the hot rolling, the $\gamma \rightarrow \alpha$ transformation must occur at a low temperature, but in a temperature region where the final pass temperature (FT) is less than the $Ar_3$ transformation point+30° C., stress induced ferrite transformation nuclei are formed and polygonal coarse ferrite is liable to end up being produced. The upper limit of the finish temperature does not have to be particularly set so far as obtaining the effects of the present invention, but there is a possibility of occurrence of scale defects in operation, so making it 1100° C. or less is preferable. Here, the $Ar_3$ transformation point temperature is simply shown in relation with the steel ingredients by for example the following calculation formula:

$$Ar_3=910-310\times\%\ C+25\times\%\ Si-80\times\%\ Mn$$

After the finish rolling ends, the steel is cooled to the designated coiling temperature (CT). The time until the start of cooling is made within 10 seconds. This is because if the time until the start of cooling is over 10 seconds, right after rolling, the steel is liable to recrystallize and the austenite grains to end up becoming coarser and the ferrite grains after the $\gamma \rightarrow \alpha$ transformation are liable to become coarser. Next, the average cooling rate until the end of cooling has to be at least 50° C./sec. This is because if the average cooling rate until the end of cooling is less than 50° C./sec, the volume fraction of the bainitic ferrite or ferrite and bainite desirable for burring is liable to end up decreasing. Further, the upper limit of the cooling rate is made 500° C./sec or less considering the actual capabilities of plant facilities. The cooling end temperature has to be in the temperature region of 700° C. or less. This is because if the cooling end temperature is over 700° C., a microstructure other than the bainitic ferrite or ferrite and bainite desirable for burring is liable to end up being formed. The lower limit of the cooling end temperature does not have to be particularly defined to obtain the effect of the present invention. However, the coiling temperature or less is impossible in view of the process of the present invention. The processes from after cooling ends to coiling are not particularly defined, but in accordance with need, it is possible to cool to the coiling temperature, but in this case springback of the sheet due to thermal stress is a concern, so 300° C./sec or less is preferable.

Next, with a coiling temperature of less than 350° C., sufficient precipitates containing Ti and/or Nb are no longer formed and a drop in strength is feared, while if over 650° C., the precipitates containing Ti and/or Nb become coarser in size and not only no longer contribute to the rise in strength by precipitation strengthening, but if the precipitates become too large, voids will easily occur at the interface between the precipitates and the matrix phase and the burring is liable to drop. Therefore, the coiling temperature is made 350° C. to 650° C. Further, the cooling rate after coiling is not particularly limited, but when adding Cu in an amount of 1% or more, if the coiling temperature (CT) is over 450° C., Cu will precipitate after coiling and the workability will deteriorate. Not only this, the solid solution state Cu effective for improving the fatigue resistance is liable to be lost, so when the coiling temperature (CT) exceeds 450° C., the cooling rate after coiling is preferably at least 30° C./sec until 200° C.

After the end of the hot rolling process, in accordance with need, the steel is pickled, then may be processed in-line or off-line by skin pass rolling with a reduction ratio of 10% or less or cold rolling until a reduction ratio of 40% or so.

Next, when the cold rolled steel sheet is the final product, the hot finish rolling conditions are not particularly limited. Further, the final pass temperature (FT) of the finish rolling may be less than the $Ar_3$ transformation point temperature, but in this case a strong worked structure remains before the rolling or during the rolling, so restoration and recrystallization are preferable in the following coiling or heat treatment. The cold rolling process after the following pickling is not particularly limited for obtaining the effect of the present invention.

The heat treatment of this cold rolled steel sheet assumes a continuous annealing process. First, this is performed at a temperature region of 800° C. or more for 5 to 150 seconds. When this heat treatment temperature is less than 800° C., in the later cooling, the bainitic ferrite or ferrite and bainite desirable for burring are liable not to be obtained, so the heat treatment temperature is made 800° C. or more. Further, the upper limit of the heat treatment temperature is not particularly defined, but due to restrictions of the continuous annealing facilities, is substantially 900° C. or less.

On the other hand, a holding time at this temperature region of less than 5 seconds is insufficient for the Ti and Nb carbides to completely redissolve. Even with over 150 seconds of heat treatment, not only is the effect saturated, but also the productivity is lowered, so the holding time is made 5 to 150 seconds.

Next, the average cooling rate until the end of cooling has to be 50° C./sec or more. This is because if the average cooling rate until the end of cooling is less than 50° C./sec, the volume fraction of the bainitic ferrite or ferrite and bainite desirable for burring is liable to end up falling. Further, the upper limit of the cooling rate, considering the capabilities of actual plant facilities etc. is 200° C./sec or less.

The cooling end temperature has to be in the temperature region of 700° C. or less, but when using a continuous annealing facility, the cooling end temperature usually never exceeds 550° C., so no special consideration is required. Further, the lower limit of the cooling end temperature does not have to be particularly set to obtain the effect of the present invention.

Further, after this, if necessary, skin pass rolling can be applied.

To coat with zinc the hot rolled steel sheet after pickling or said cold rolled steel sheet after the heat treatment process, the sheet may be dipped in a zinc coating bath. It may also be alloyed in accordance with need.

EXAMPLES

Below, examples will be used to further explain the present invention.

Each of the steels A to M having the chemical ingredients shown in Table 1 was melted in a converter, continuously cast, reheated at the heating temperature shown in Table 2, rough rolled, then finish rolled to a thickness of 1.2 to 5.5 mm, then coiled. Note that the chemical compositions in the tables are expressed in wt %. Note that as shown in Table 2, some steels were pickled, cold rolled, and heat treated after the hot rolling process. The sheet thicknesses were 0.7 to 2.3 mm. On the other hand, among said steel sheets, the steel H and steel C-7 were zinc coated.

Details of the production conditions are shown in Table 2. Here, "SRT" indicates the slab heating temperature, "FT" the final pass finish rolling temperature, "start time" the time from the end of rolling to the start of cooling, "cooling rate" the average cooling rate from the start of cooling to the end of cooling, and "CT" the coiling temperature. However, when rolling later by cold rolling, the steels are not limited in this way, so "-" is indicated.

Figure 3A:
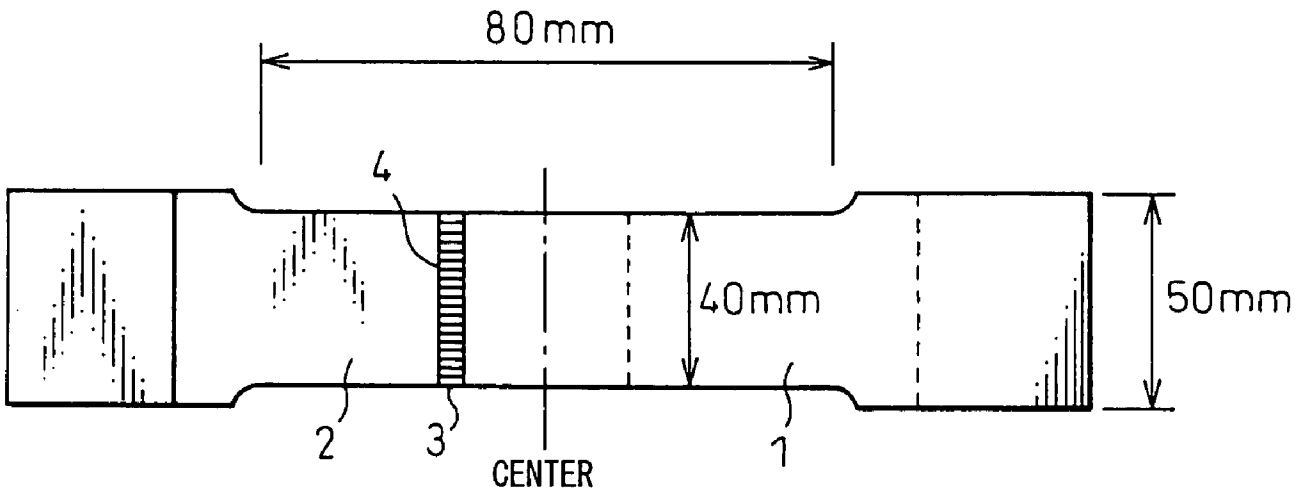
FIG. 3(*a*) is a plan view of the test piece of the hot-rolled steel sheet according to JIS Z 2201 under the test method of JIS Z 2241, and FIG. 3(*b*) is a side view of this test piece.
Figure 3B:
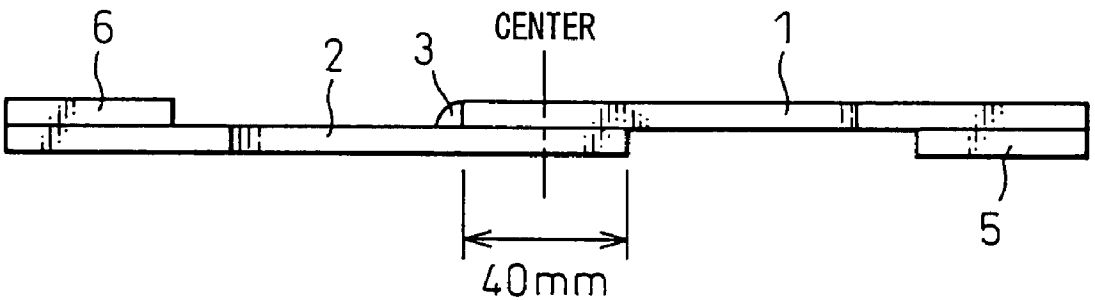

The tensile test for each of the thus obtained hot rolled sheets was conducted, as shown in FIG. 3(*a*) and FIG. 3(*b*), by first working the sheet to a No. 5 test piece described in JIS Z 2201, then following the test method described in JIS Z 2241. In FIG. 3(*a*) (plan view) and FIG. 3(*b*) (side view), 1 and 2 indicate steel sheets (test pieces), 3 a weld metal, 4 a joint, and 5 and 6 auxiliary sheets. Table 2 shows the yield point (YP), tensile strength (TS), and elongation at break (El). On the other hand, burring was evaluated by the burring test method described in the Japan Iron and Steel Federation standard JFS T 1001-1996. Table 2 shows the burring rate (λ). Here, the volume fractions of ferrite, bainite, residual austenite, pearlite, and martensite are defined as the area fractions of the microstructure at ¼ sheet thickness when polishing a sample cut out from a ¼ W or ¾ W position of the thickness of the steel sheet at the cross-section in the rolling direction, etching it with a Nytal reagent, and observing it using an optical microscope at a power of ×200 to ×500. Further, a weld joint tensile test piece shown in FIG. 3 was used to conduct a tensile test by a method based on JIS Z 2241. The fracture locations were classified as matrix/weld zone by visual observation of the appearance. From the viewpoint of the joint strength, the weld fracture location is more preferably the matrix than the weld zone.

Note that the hardness of the weld heat affected zone of arc welding was measured by a No. 1 test piece described in JIS Z 3101 based on the test method described in JIS Z 2244. Note that the arc welding was performed with a shield gas of $CO_2$, a wire of YM-60C, ϕ1.2 mm or YM-80C, ϕ1.2 mm made by Nippon Steel Welding Products and Engineering Co., Ltd., a welding rate of 100 cm/min, a welding current of 260±10A, a welding voltage of 26±1V, a thickness of the test material of 2.6 mm, a hardness measurement position of 0.25 mm from the surface, a measurement distance of 0.5 mm, and a test force of 98N.

The steels in accordance with the present invention were the nine steels of the steels A, B, C-1, C-7, F, H, K, L, and M. These gave high burring, high strength steel sheet excellent in softening resistance of the weld heat affected zone containing the predetermined amounts of steel ingredients and having microstructures comprised of ferrite or ferrite and bainite. Therefore, significant differences were recognized with respect to the heat affected zone softening degree ΔHv of 50 or more of the conventional steels evaluated by the method described in the present invention. Further, for the steel F, due to the effect of the addition of B, the hardenability was improved at the locations of the weld heat affected zone where α-γ-α transformation occurred. As a result, the fracture location became the matrix.

The other steels are outside the scope of the present invention due to the following reasons. That is, the steel C-2 had a finish rolling end temperature (FT) outside the scope of the present intention, so the desired microstructure could not be obtained and sufficient burring (λ) could not be obtained. The steel C-3 had a time from the end of finish rolling to the start of cooling outside the scope of the present invention, so the target microstructure could not be obtained and sufficient burring (λ) could not be obtained. The steel C-4 had an average cooling rate outside the scope of the present invention, so the target microstructure could not be obtained and sufficient burring (λ) could not be obtained. The steel C-5 had a cooling end temperature and coiling temperature outside the scope of the present invention, so the target microstructure could not be obtained and sufficient burring (λ) could not be obtained. The steel C-6 had a coiling temperature outside the scope of the present invention, so the target microstructure could not be obtained and sufficient burring (λ) could not be obtained. The steel C-8 had a heat treatment temperature outside the scope of the present invention, so the target microstructure could not be obtained and sufficient burring (λ) could not be obtained. The steel C-9 had a holding time outside the scope of the present invention, so the target microstructure could not be obtained and sufficient burring (λ) could not be obtained. The steel D had a C* outside the scope of the present invention, so the softening degree of the heat affected zone (ΔHv) was large. The steel E had an amount of C added and C and C* outside the scope of the present invention, so sufficient burring (λ)could not be obtained. The steel G had an amount of Mo+Cr outside the scope of the present invention, so the softening degree of the heat affected zone (ΔHv) was large. The steel I had an amount of Mo+Cr outside the scope of the present invention, so the softening degree of the heat affected zone (ΔHv) was large. The steel J had a C* outside the scope of the present invention, so sufficient burring (λ) could not be obtained.

TABLE 1

| | Chemical composition (unit: wt %) | | | | | | | | | | | | | | |
|---|---|---|---|---|---|---|---|---|---|---|---|---|---|---|---|
| Steel | C | Si | Mn | P | S | Al | N | Ti | Nb | Mo | Cr | Mo + Cr | C* | Others | Remarks |
| A | 0.063 | 0.03 | 0.51 | 0.005 | 0.0008 | 0.031 | 0.0028 | 0.089 | 0.036 | 0.11 | 0.10 | 0.210 | 0.039 | | Invention |
| B | 0.082 | 1.60 | 2.10 | 0.084 | 0.0010 | 0.015 | 0.0033 | 0.131 | 0.041 | 0.10 | 0.12 | 0.220 | 0.047 | Ca: 0.0011 | Invention |
| C | 0.055 | 0.91 | 1.33 | 0.005 | 0.0011 | 0.035 | 0.0026 | 0.122 | 0.032 | | 0.30 | 0.300 | 0.023 | | Invention |
| D | 0.024 | 1.02 | 1.41 | 0.010 | 0.0010 | 0.022 | 0.0022 | 0.110 | 0.035 | 0.26 | | 0.260 | −0.006 | | Comparative |
| E | 0.120 | 1.02 | 1.36 | 0.008 | 0.0007 | 0.024 | 0.0045 | 0.060 | | | 0.21 | 0.210 | 0.109 | | Comparative |
| F | 0.052 | 0.88 | 1.35 | 0.018 | 0.0020 | 0.018 | 0.0028 | 0.116 | | 0.22 | | 0.220 | 0.026 | B: 0.0003 | Invention |
| G | 0.061 | 0.87 | 1.29 | 0.007 | 0.0011 | 0.022 | 0.0042 | 0.114 | 0.031 | | | 0.000 | 0.033 | | Comparative |
| H | 0.053 | 0.86 | 1.41 | 0.007 | 0.0012 | 0.031 | 0.0031 | 0.112 | 0.025 | 0.25 | | 0.250 | 0.025 | Cu: 0.8, Ni: 0.3 | Invention |
| I | 0.058 | 0.94 | 1.28 | 0.003 | 0.0070 | 0.022 | 0.0038 | 0.121 | 0.038 | | | 0.000 | 0.029 | | Comparative |
| J | 0.088 | 0.78 | 1.16 | 0.011 | 0.0009 | 0.031 | 0.0039 | 0.103 | | 0.16 | 0.21 | 0.370 | 0.066 | | Comparative |
| K | 0.060 | 0.90 | 1.40 | 0.007 | 0.0010 | 0.036 | 0.0045 | 0.121 | 0.019 | 0.20 | 0.09 | 0.290 | 0.032 | REM: 0.0008 | Invention |
| L | 0.035 | 1.10 | 1.51 | 0.006 | 0.0008 | 0.036 | 0.0018 | 0.091 | | | 0.32 | 0.320 | 0.014 | | Invention |
| M | 0.033 | 1.12 | 1.31 | 0.006 | 0.008 | 0.036 | 0.0034 | 0.096 | | 0.26 | | 0.260 | 0.012 | Cu: 0.3 | Invention |

TABLE 2

| | | Production conditions | | | | | | | | | | | |
|---|---|---|---|---|---|---|---|---|---|---|---|---|---|
| | | Hot rolling process | | | | | | | Cold rolling, heat treat. processes | | Microstructure | | |
| Steel | Class | SRT (° C.) | FT (° C.) | $Ar_3$ + 30 (° C.) | Start time (s) | Cooling rate (° C./s) | Cooling end temp. (° C.) | Coiling temp. (° C.) | Heat treat. temp. (° C.) | Holding time (s) | Ferrite (%) | Bainite (%) | Other (%) |
| A | HR | 1230 | 960 | 880 | 5 | 70 | 680 | 500 | — | — | 100 | 0 | 0 |
| B | HR | 1230 | 910 | 787 | 5 | 70 | 680 | 500 | — | — | 90 | 10 | 0 |
| C-1 | HR | 1230 | 950 | 839 | 5 | 70 | 680 | 500 | — | — | 100 | 0 | 0 |
| C-2 | HR | 1230 | 800 | 839 | 5 | 50 | 680 | 500 | — | — | 80 | 10 | 10 |
| C-3 | HR | 1230 | 950 | 839 | 12 | 70 | 680 | 500 | — | — | 80 | 15 | 5 |
| C-4 | HR | 1230 | 950 | 839 | 5 | 10 | 680 | 500 | — | — | 60 | 10 | 30 |
| C-5 | HR | 1230 | 950 | 839 | 5 | 70 | 740 | 700 | — | — | 70 | 10 | 20 |
| C-6 | HR | 1230 | 950 | 839 | 5 | 70 | 680 | 150 | — | — | 75 | 5 | 20 |
| C-7 | CR | — | — | — | — | — | — | — | 850 | 120 | 100 | 0 | 0 |
| C-8 | CR | — | — | — | — | — | — | — | 750 | 120 | 70 | 30 | 0 |
| C-9 | CR | — | — | — | — | — | — | — | 850 | 1 | 100 | 0 | 0 |
| D | HR | 1180 | 900 | 845 | 7 | 60 | 700 | 600 | — | — | 100 | 0 | 0 |
| E | HR | 1180 | 910 | 820 | 7 | 60 | 700 | 600 | — | — | 70 | 30 | 0 |
| F | HR | 1180 | 920 | 838 | 7 | 60 | 700 | 600 | — | — | 100 | 0 | 0 |
| G | HR | 1180 | 910 | 840 | 7 | 60 | 700 | 600 | — | — | 100 | 0 | 0 |
| H | HR | 1180 | 930 | 832 | 7 | 60 | 700 | 600 | — | — | 100 | 0 | 0 |
| I | HR | 1180 | 900 | 843 | 7 | 60 | 700 | 600 | — | — | 100 | 0 | 0 |
| J | HR | 1180 | 900 | 839 | 7 | 60 | 700 | 600 | — | — | 80 | 20 | 0 |
| K | HR | 1180 | 930 | 832 | 7 | 60 | 700 | 600 | — | — | 100 | 0 | 0 |
| L | HR | 1180 | 920 | 836 | 7 | 60 | 700 | 600 | — | — | 100 | 0 | 0 |
| M | HR | 1180 | 920 | 853 | 7 | 60 | 700 | 600 | — | — | 100 | 0 | 0 |

| | Mechanical properties | | | | Heat affected zone | | Joint tensile | |
|---|---|---|---|---|---|---|---|---|
| Steel | YP (MPa) | TS (MPa) | El (%) | λ (%) | Wire | ΔHv (98N) | fracture behavior Fracture location | Remarks |
| A | 542 | 603 | 27 | 147 | YM-28 | −10 | Matrix | Inv. |
| B | 906 | 1011 | 16 | 61 | YM-80C | 40 | Weld zone | Inv. |
| C-1 | 716 | 796 | 23 | 110 | YM-60C | 25 | Weld zone | Inv. |
| C-2 | 680 | 774 | 23 | 55 | YM-60C | 30 | Weld zone | Comp. |
| C-3 | 677 | 763 | 24 | 46 | YM-60C | 20 | Weld zone | Comp. |
| C-4 | 570 | 740 | 22 | 35 | YM-60C | 20 | Weld zone | Comp. |
| C-5 | 523 | 748 | 24 | 40 | YM-60C | 25 | Weld zone | Comp. |
| C-6 | 622 | 846 | 25 | 33 | YM-60C | 40 | Weld zone | Comp. |
| C-7 | 700 | 801 | 20 | 87 | YM-60C | 20 | Weld zone | Inv. |
| C-8 | 542 | 733 | 21 | 26 | YM-60C | 40 | Weld zone | Comp. |
| C-9 | 791 | 861 | 6 | 30 | YM-60C | 55 | Weld zone | Comp. |
| D | 697 | 774 | 22 | 120 | YM-60C | 90 | Weld zone | Comp. |

TABLE 2-continued

| | | | | | | | | |
|---|---|---|---|---|---|---|---|---|
| E | 780 | 885 | 19 | 35 | YM-60C | 30 | weld zone | Comp. |
| F | 710 | 789 | 22 | 105 | YM-60C | 15 | Matrix | Inv. |
| G | 714 | 793 | 22 | 100 | YM-60C | 70 | Weld zone | Comp. |
| H | 706 | 797 | 20 | 82 | YM-60C | 20 | Weld zone | Inv. |
| I | 693 | 796 | 21 | 85 | YM-60C | 85 | Weld zone | Comp. |
| J | 719 | 799 | 23 | 51 | YM-60C | 20 | Weld zone | Comp. |
| K | 729 | 810 | 20 | 96 | YM-60C | 10 | Weld zone | Inv. |
| L | 725 | 805 | 20 | 97 | YM-60C | 10 | Weld zone | Inv. |
| M | 730 | 816 | 19 | 90 | YM-60C | 20 | Weld zone | Inv. |

HR: Hot rolling,
CR: cold rolling

INDUSTRIAL APPLICABILITY

As explained above in detail, the present invention relates to high burring, high strength steel sheet having a tensile strength of 540 MPa or more excellent in softening resistance of the weld heat affected zone and a method of production of the same. By use of such thin steel sheet, a great improvement can be expected in the softening resistance of the weld heat affected zone in the case of spot, arc, plasma, laser, or other welding after being formed or the case of being formed after such welding.

The invention claimed is:

1. High burring, high strength, hot-rolled steel sheet excellent in softening resistance of the weld heat affected zone characterized by consisting essentially of, by wt %, C: 0.01 to 0.1%, Si: 0.01 to 2%, Mn: 0.05 to 3%,

P≦0.1%,

S≦0.03%,

Al: 0.005 to 1%,

N: 0.0005 to 0.005%,

Ti: 0.05 to 0.5%, and

Nb: 0.01 to 0.5% and further containing C, S, N, Ti, Nb, Cr, and Mo in ranges satisfying $0\% < C-(12/48Ti+12/93Nb-12/14N-12/32S) \leqq 0.05\%$, and $Mo+Cr \geqq 0.2\%$, $Cr \leqq 0.5\%$, and $Mo \leqq 0.5\%$, the balance comprising Fe and unavoidable impurities, wherein the microstructure is composed of only bainitic ferrite and bainite, wherein an effective amount of solid solution C is present in said hot-rolled steel sheet to form carbon clusters or precipitates with Mo and Cr to achieve excellent softening resistance at the weld heat affected zone when welded.

2. High burring, high strength, hot-rolled steel sheet excellent in softening resistance of the weld heat affected zone as set forth in claim 1, characterized by further consisting essentially of, by wt %, one or two of Ca: 0.0005 to 0.002%, a REM: 0.0005 to 0.02%, and B: 0.0002 to 0.002%.

3. High burring, high strength, hot-rolled steel sheet excellent in softening resistance of the weld heat affected zone as set forth in claim 1, characterized by being automotive thin steel sheet coated with zinc.

4. High buffing, high strength, hot-rolled steel sheet excellent in softening resistance of the weld heat affected zone as set forth in claim 1 characterized by consisting essentially of, by wt %, C: 0.01 to 0.1%, Si: 0.01 to 2%, Mn: 0.05 to 3%,

P≦0.1%,

S≦0.03%,

Al: 0.005 to 1%,

N: 0.0005 to 0.005%, and

Ti: 0.05 to 0.5%

Nb: 0.01 to 0.5% and further containing C, S, N, Ti, Cr, and Mo in ranges satisfying $0\% < C-(12/48Ti+12/93Nb-12/14N-12/32S) \leqq 0.05\%$, and $Mo+Cr \geqq 0.2\%$, $Cr \leqq 0.5\%$, and $Mo \leqq 0.5\%$, the balance comprising Fe and unavoidable impurities, wherein the microstructure is composed of only bainitic ferrite and bainite, wherein the bainitic ferrite structure contained in the hot-rolled steel sheet before welding does not include carbides inside ferrite laths and between ferrite laths other than Ti and Nb carbides.

* * * * *